US008333633B2

(12) United States Patent
Liu et al.

(10) Patent No.: US 8,333,633 B2
(45) Date of Patent: Dec. 18, 2012

(54) METHOD FOR FORMING TIP FOR CARBON NANOTUBE AND METHOD FOR FORMING FIELD EMISSION STRUCTURE HAVING THE SAME

(75) Inventors: Peng Liu, Beijing (CN); Duan-Liang Zhou, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/248,439

(22) Filed: Sep. 29, 2011

(65) Prior Publication Data

US 2012/0171920 A1 Jul. 5, 2012

(30) Foreign Application Priority Data

Dec. 30, 2010 (CN) ..... 2010 1 0616298

(51) Int. Cl.
*H01J 1/62* (2006.01)
*H01J 63/04* (2006.01)
*H01J 9/00* (2006.01)

(52) U.S. Cl. ..... 445/29; 313/495; 445/1; 445/24; 445/25; 445/28

(58) Field of Classification Search ..... None
See application file for complete search history.

(56) References Cited

U.S. PATENT DOCUMENTS

| | | | | |
|---|---|---|---|---|
| 7,967,655 | B2 * | 6/2011 | Wei et al. | 445/51 |
| 7,997,950 | B2 * | 8/2011 | Wei et al. | 445/50 |
| 2006/0147647 | A1 * | 7/2006 | Azami et al. | 427/510 |
| 2009/0115306 | A1 | 5/2009 | Wei et al. | |
| 2009/0195139 | A1 | 8/2009 | Wei et al. | |

FOREIGN PATENT DOCUMENTS

| | | | |
|---|---|---|---|
| CN | 101425435 | A | 5/2009 |
| CN | 101499390 | A | 8/2009 |

* cited by examiner

*Primary Examiner* — Natalie Walford
(74) *Attorney, Agent, or Firm* — Altis Law Group, Inc.

(57) ABSTRACT

A method for forming a tip for a carbon nanotube wire is introduced. The method includes the following steps. A carbon nanotube wire is provided. A laser beam irradiates the carbon nanotube wire until the carbon nanotube wire is broken off such that the carbon nanotube wire forms a taper-shaped tip. A scan power of the laser beam is in a range from about 1 watt to about 10 watts. A scan speed of the laser beam is equal to or less than 200 millimeters per second.

20 Claims, 16 Drawing Sheets

METHOD FOR FORMING TIP FOR CARBON NANOTUBE AND METHOD FOR FORMING FIELD EMISSION STRUCTURE HAVING THE SAME

This application claims all benefits accruing under 35 U.S.C. §119 from China Patent Application No. 201010616298.0, filed on Dec. 30, 2010 in the China Intellectual Property Office, disclosure of which is incorporated herein by reference.

BACKGROUND

1. Technical Field

The present disclosure relates to a method for forming a tip for a carbon nanotube wire, and a method for forming a field emission structure having the carbon nanotube wire.

2. Description of Related Art

Carbon nanotubes were first produced by means of arc discharge between graphite rods. Carbon nanotubes feature extremely high electrical conductivity, very small diameters (much smaller than 100 nanometers), large aspect ratios (i.e. length/diameter ratios greater than 1000), and a tip-surface area near the theoretical limit (the smaller the tip-surface area, the more concentrated the electric field, and the greater the field enhancement factor). These features tend to make carbon nanotubes ideal candidates for electron emitters of field emission displays.

Carbon nanotubes prepared by conventional methods are in the dimensions of micro-scale. The micro-scale carbon nanotubes limit carbon nanotube features. Thus, preparation of macro-scale carbon nanotube structures, such as carbon nanotube wires or carbon nanotube films, has attracted much attention. The carbon nanotube wires are solid linear structures. The carbon nanotube films are sheet-shaped structures. However, macro-scale carbon nanotubes and methods for making these are not known.

What is needed, therefore, is to provide a method for making macro-scale carbon nanotubes, such as carbon nanotube wires, having high field enhancement factor for electron emitters.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
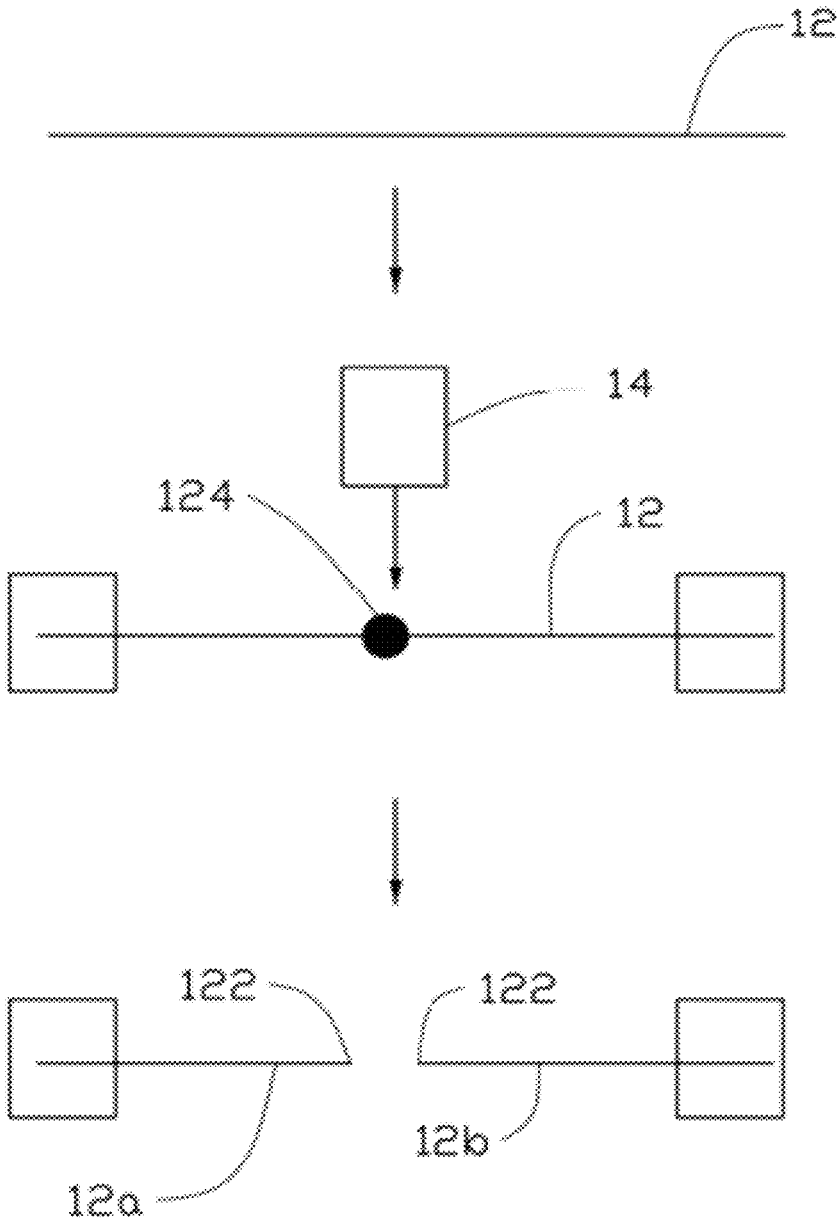
FIG. 1 is a schematic view of one embodiment of forming a tip for a carbon nanotube wire.

Referring to FIG. 1, one embodiment of a method forming a tip for a carbon nanotube wire includes the steps of:

S110, providing a carbon nanotube wire 12; and

S120, irradiating the carbon nanotube wire 12 by a laser beam 14 until the carbon nanotube wire 12 is broken off such that the carbon nanotube wire 12 forms a taper-shaped tip 122, the taper-shaped tip 122 including a number of carbon nanotubes, each of the carbon nanotubes having closed ends.

In the step 120, a scan power of the laser beam 14 is in a range from about 1 watt to about 10 watts. A scan speed of the laser beam 14 is equal to or less than 200 millimeters per second.

Figure 2:
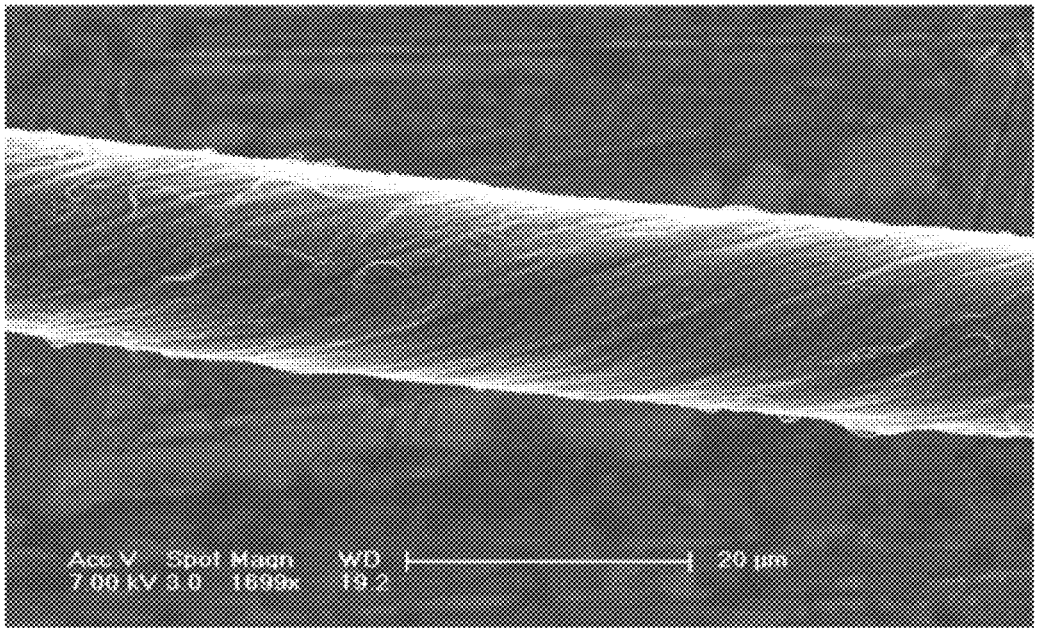
FIG. 2 shows a scanning electron microscope (SEM) image of one embodiment of a carbon nanotube wire.

Referring to FIG. 2, the carbon nanotube wire 12 includes a plurality of carbon nanotubes helically oriented around an axial direction of the carbon nanotube wire 12. In one embodiment, the carbon nanotube wire 12 includes a plurality of successive carbon nanotubes joined end to end by van der Waals force therebetween. The length of the carbon nanotube wire 12 can be set as desired. The diameter of the carbon nanotube wire 12 can be from about 0.5 nanometers to about 100 micrometers. In one embodiment, a diameter of the carbon nanotube wire 12 is about 5 micrometers.

One embodiment of a method for making a carbon nanotube wire 12, includes the following steps:

S111, providing a carbon nanotube array on a substrate;

S112, pulling a drawn carbon nanotube film out from the carbon nanotube array; and S113, processing the drawn carbon nanotube film to form the carbon nanotube wire 12.

In the step 111, the carbon nanotube array can be a super-aligned array of carbon nanotubes. However, any carbon nanotube array from which a film can be drawn may be used. The carbon nanotube array of carbon nanotubes can be formed by the steps of:

(a1), providing a substantially flat and smooth substrate;

(b1), forming a catalyst layer on the substrate;

(c1), annealing the substrate with the catalyst layer thereon in air at a temperature in a range from about 700° C. to about 900° C. for about 30 minutes to about 90 minutes;

(d1), heating the substrate with the catalyst layer thereon at a temperature in a range from about 500° C. to about 740° C. in a furnace with a protective/reducing gas therein; and (e1), supplying a carbon source gas to the furnace for about 5 minutes to about 30 minutes, and growing a carbon nanotube array of carbon nanotubes on the substrate.

In the step (a1), the substrate can be a P-type silicon wafer, an N-type silicon wafer, or a silicon wafer with a film of silicon dioxide thereon. In one embodiment, a four inch P-type silicon wafer is used as the substrate. In the step (b1), the catalyst can be made of iron (Fe), cobalt (Co), nickel (Ni), or any combination thereof.

In the step (d1), the protective/reducing gas can be made up of at least one of nitrogen ($N_2$), ammonia ($NH_3$), and a noble gas. In the step (e1), the carbon source gas can be a hydrocarbon gas, such as ethyne ($C_2H_2$), ethylene ($C_2H_4$), methane ($CH_4$), acetylene ($C_2H_2$), ethane ($C_2H_6$), or any combination thereof. In one embodiment, the protective/reducing gas is argon, and the carbon source gas is ethyne.

In one embodiment, the carbon nanotubes in the carbon nanotube array have a height of about 100 micrometers. The carbon nanotube array formed under the above conditions is essentially free of impurities, such as carbonaceous or residual catalyst particles. The carbon nanotubes in the carbon nanotube array are closely packed together by the van der Waals force.

In the step S112, the drawn carbon nanotube film can be pulled out from the carbon nanotube array by the steps of: (a2), contacting the carbon nanotube array with an adhesive bar; and (b2), moving the adhesive bar away from the carbon nanotube array.

In the step (a2), the adhesive bar can include a body with a side surface covered by an adhesive layer. The side surface of the body can be made of a material that has a great attractive force to the carbon nanotubes. Therefore, the side surface of the body can be used as a contacting surface to contact a number of carbon nanotubes of the carbon nanotube array, and the carbon nanotubes can be firmly adhered to the side surface of the adhesive bar. The adhesive bar can be fixed to a stretching device via a fixing device. The fixing device can be a generally U-shaped clamp with an adjustable opening facing the carbon nanotube array.

In the step (b2), if the adhesive bar is driven to move away from the carbon nanotube array, a number of carbon nanotube segments can be pulled out from the carbon nanotube array end-to-end to form the drawn carbon nanotube film due to the van der Waals force between adjacent carbon nanotube segments. During the pulling process, an angle between a direction of pulling the drawn carbon nanotube film and the longitudinal direction of the carbon nanotube array can be in a range from about 30 degrees to about 90 degrees. In one embodiment, the angle between the direction of pulling the drawn carbon nanotube film and the longitudinal direction of the carbon nanotube array is about 85 degrees. An angle of about 85 degrees has been found to improve a uniformity of the drawn carbon nanotube film.

In the step S113, the carbon nanotube wire 12 can be obtained by twisting a drawn carbon nanotube film using a mechanical force to turn the two ends of the drawn carbon nanotube film in opposite directions. The carbon nanotube wire 12 includes a number of carbon nanotubes helically oriented around an axial direction of the carbon nanotube wire 12.

More specifically, a volatile solvent can be applied to soak the carbon nanotube wire 12. During the soaking, adjacent carbon nanotubes in the carbon nanotube wire 12 will bundle together due to the surface tension of the volatile solvent as it volatilizes.

The carbon nanotube wire 12 can be untwisted. The untwisted carbon nanotube wire 12 includes a number of carbon nanotubes substantially oriented along a same direction. The carbon nanotubes are substantially arranged along an axial direction of the untwisted carbon nanotube wire 12. In other words, the carbon nanotubes are substantially parallel to the axial direction of the untwisted carbon nanotube wire 12. In one embodiment, the untwisted carbon nanotube wire 12 includes a number of successive carbon nanotubes joined end to end by van der Waals force therebetween.

In the step 120, the carbon nanotube wire 12 can be irradiated by the steps of:

S121, deposing the carbon nanotube wire 12 in a chamber with oxidizing gas; and S122, irradiating the carbon nanotube wire 12 at a predetermined position 124 by the laser beam 14 until the carbon nanotube wire 12 is broken off at the predetermined position 124 to form two separated carbon nanotube wires 12*a* and 12*b*.

In the step S121, a volume percentage of the oxidizing gas in the chamber is greater than about 25%. The chamber can be filled with pure oxygen or air. In one embodiment, the chamber is filled with air.

In the step S122, the carbon nanotube wire 12*a* has a taper-shaped tip 122. The carbon nanotube wire 12*b* has a taper-shaped tip 122. A scan power of the laser beam 14 is in a range from about 1 watt to about 10 watts. A scan speed of the laser beam 14 is equal to or less than about 200 millimeters per second. The scan power is the output power of the laser beam 14. The scan speed is a moving speed of a facula of the laser beam 14 at the focus plane.

The carbon nanotube wire 12 is substantially perpendicularly irradiated by the laser beam 14 at the predetermined position 124. More specifically, a scanning path of the laser beam 14 is controlled by a program. Thus, the facula of the laser beam 14 moves along a direction substantially perpendicular to the axial direction of the carbon nanotube wire 12 to break off the carbon nanotube wire 12 at the predetermined position 124. In one embodiment, the scan power of the laser beam 14 is in a range from about 3.6 watts to about 6 watts. The scan speed of the laser beam 14 is in a range from about 5 millimeters per second to about 100 millimeters per second. Preferably, the scan speed of the laser beam 14 is in a range from about 5 millimeters per second to about 10 millimeters per second. The laser beam 14 can be a carbon dioxide laser, a semiconductor laser, an ultraviolet laser, or a yttrium aluminium garnet (YAG) laser. The laser can work at a continuous mode or pulse mode. The frequency of the pulse mode can be at a range from 200 Hz to 400 KHz. Preferably, the frequency of the pulse mode is at a range from 10 KHz to 50 KHz.

An interval between the taper-shaped tips 122 of the carbon nanotube wire 12*a* and the carbon nanotube wire 12*b* is smaller than about 70 micrometers. In one embodiment, the interval between the taper-shaped tips 122 of the carbon nanotube wire 12*a* and the carbon nanotube wire 12*b* is in a range from about 15 micrometers to about 65 micrometers.

Figure 8:
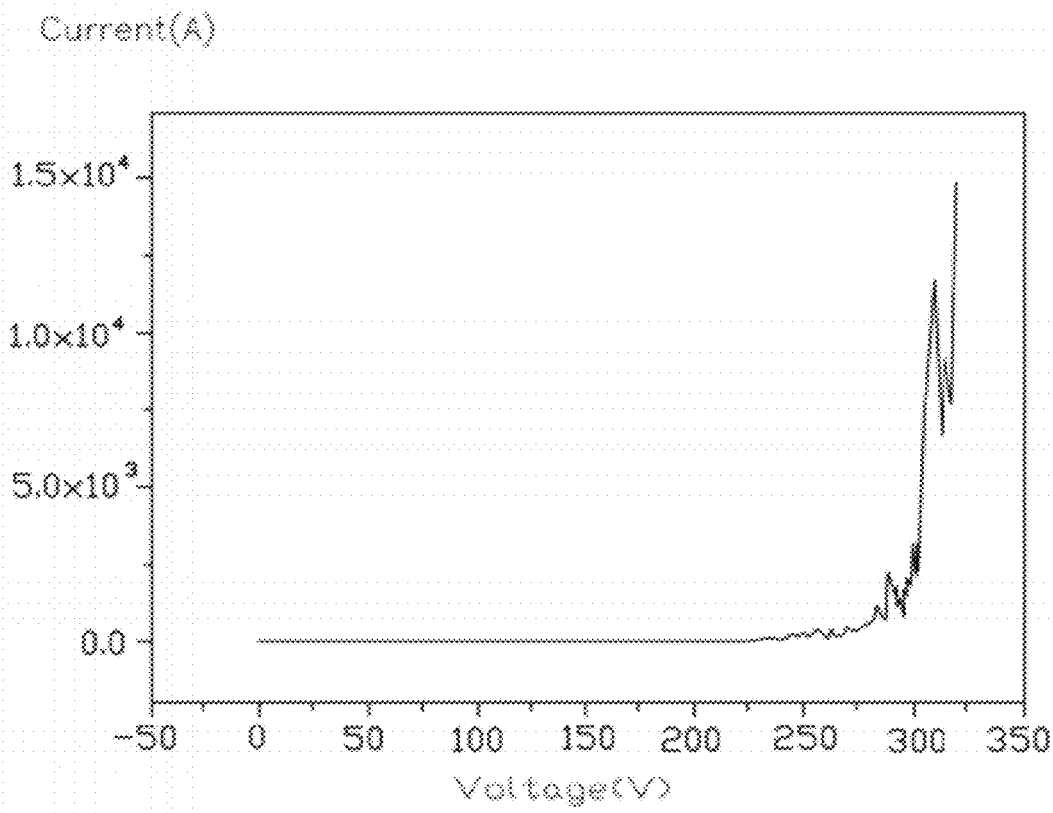
FIG. 8 is a waveform chart of a current-voltage characteristic curve of a taper-shaped tip of a broken carbon nanotube wire.

Referring to FIG. 4 to FIG. 7, the carbon nanotubes of the taper-shaped tip 122 are substantially parallel to the axial direction of the carbon nanotube wire 12. A cone angle of the taper-shaped tip 122 is in a range from about 10 degrees to about 17 degrees. Preferably, the cone angle of the taper-shaped tip 122 is in a range from about 12 degrees to about 15 degrees. Thus, referring to FIG. 8, the taper-shaped tip 122 of the broken carbon nanotube wire 12 has high field emission ability.

If the scan power of the laser beam 14 is in a range from about 1 watt to about 10 watts and the scan speed of the laser beam 14 is greater than about 200 millimeters per second, the time period that the laser beam 14 irradiates the carbon nanotube wire 12 is shorter. The predetermined position 124 of the carbon nanotube wire 12 receives less power, thus the carbon nanotube wire 12 is difficult to break off.

If the scan power of the laser beam 14 is smaller than about 1 watt and the scan speed of the laser beam 14 is smaller than about 200 millimeters per second, the predetermined position 124 of the carbon nanotube wire 12 receives less power. Thus, the carbon nanotube wire 12 is difficult to break off.

Figure 3:
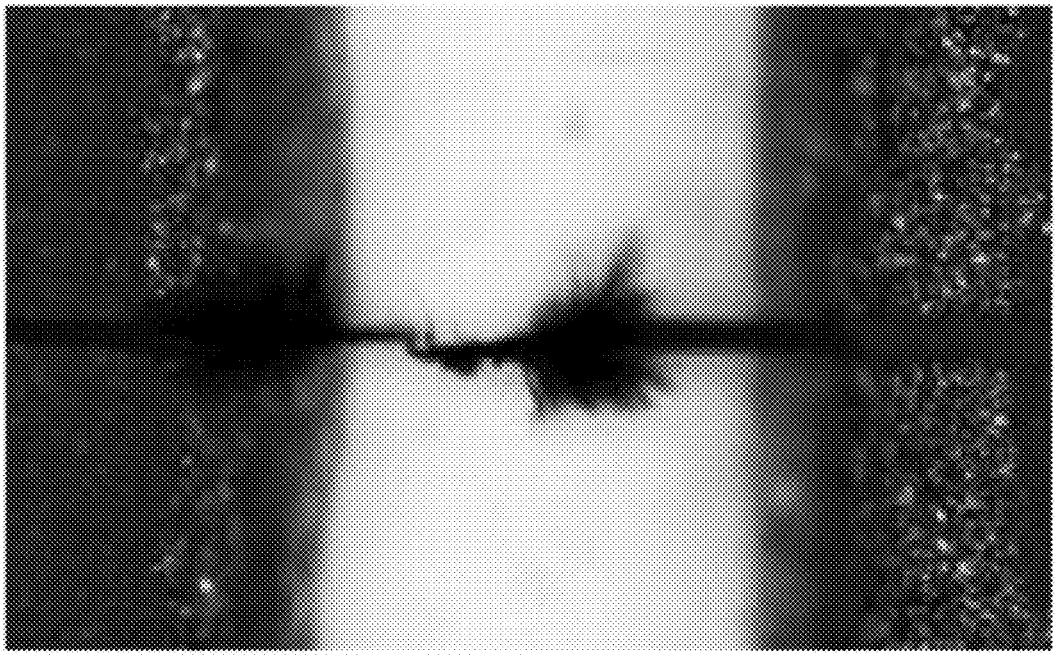
FIG. 3 is a SEM image of one embodiment of a carbon nanotube wire with a prickly tip.
Figure 4:
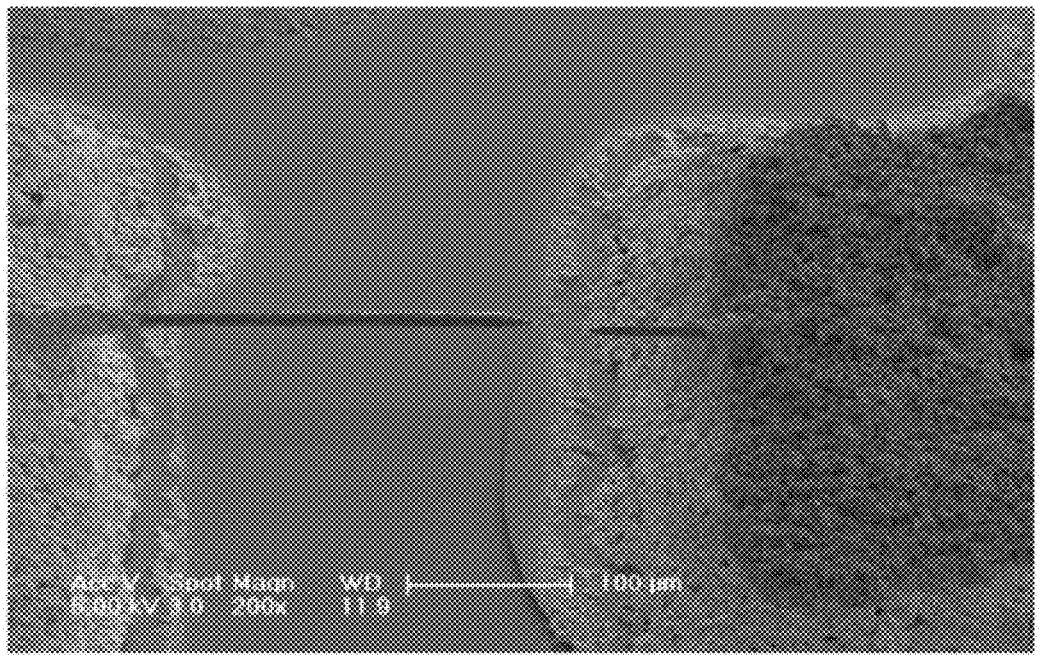
FIG. 4 shows a SEM image of one embodiment of a broken carbon nanotube wire with a taper-shaped tip.
Figure 5:
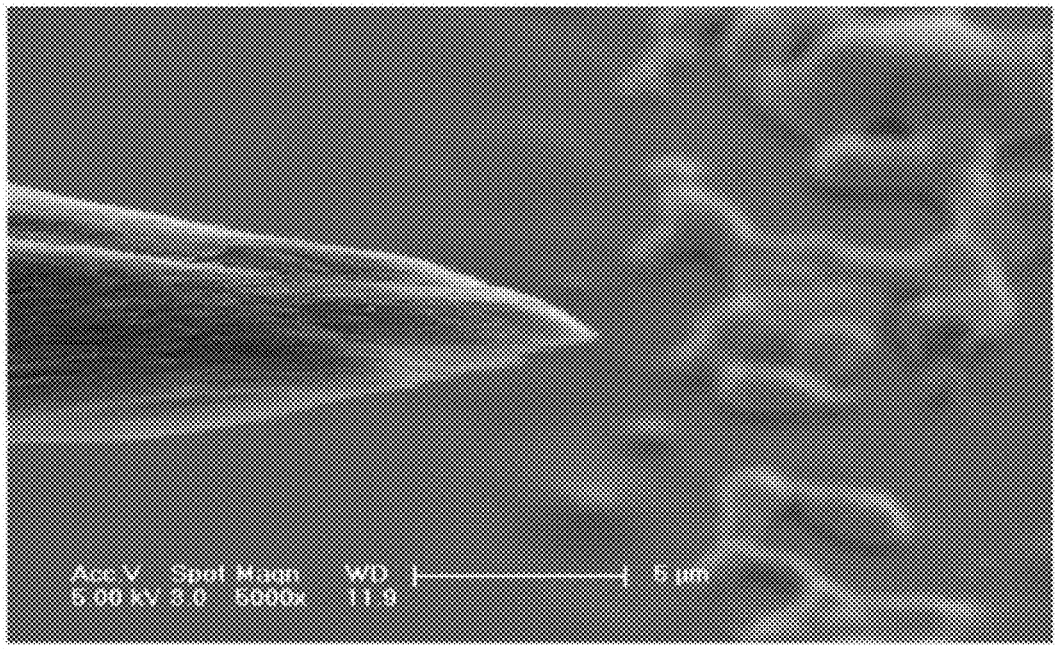
FIG. 5 shows a SEM image of the taper-shaped tip of the broken carbon nanotube wire shown in FIG. 4.
Figure 6:
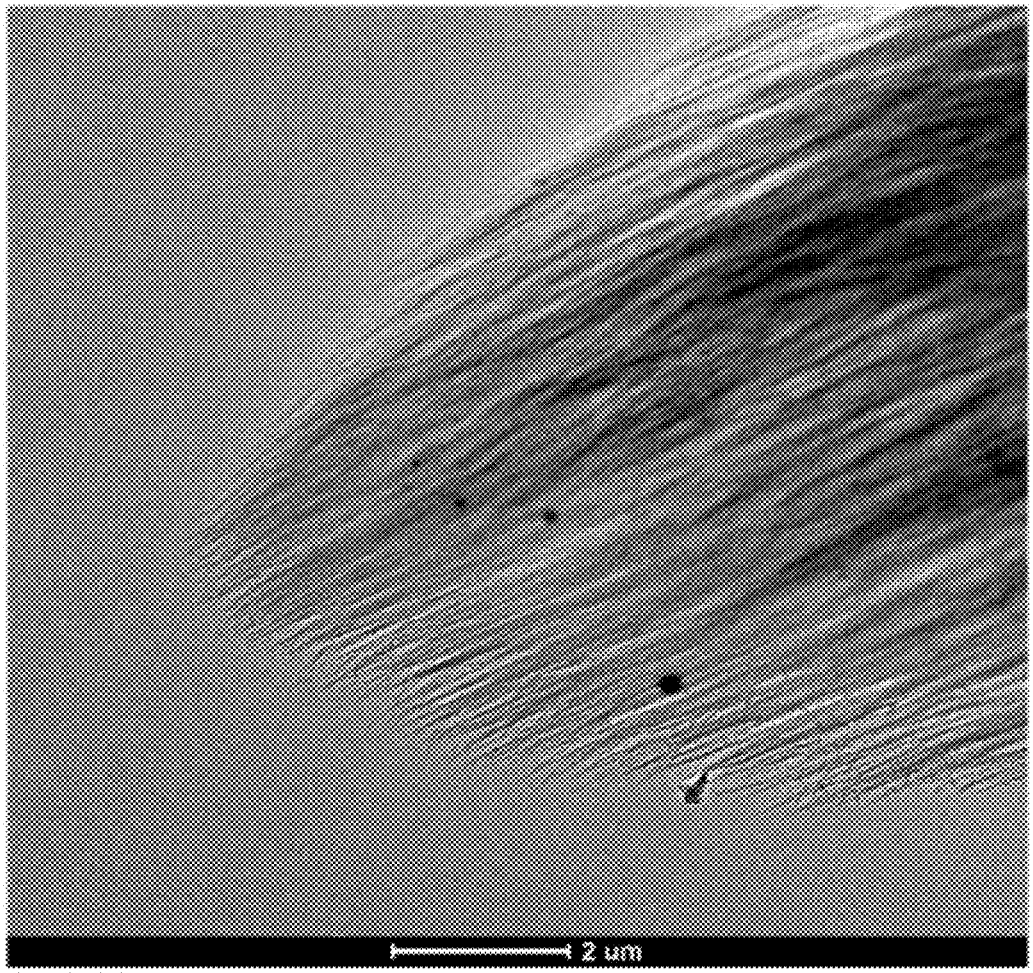
FIG. 6 shows a transmission electron microscope (TEM) image of the taper-shaped tip of the broken carbon nanotube wire shown in FIG. 4.
Figure 7:
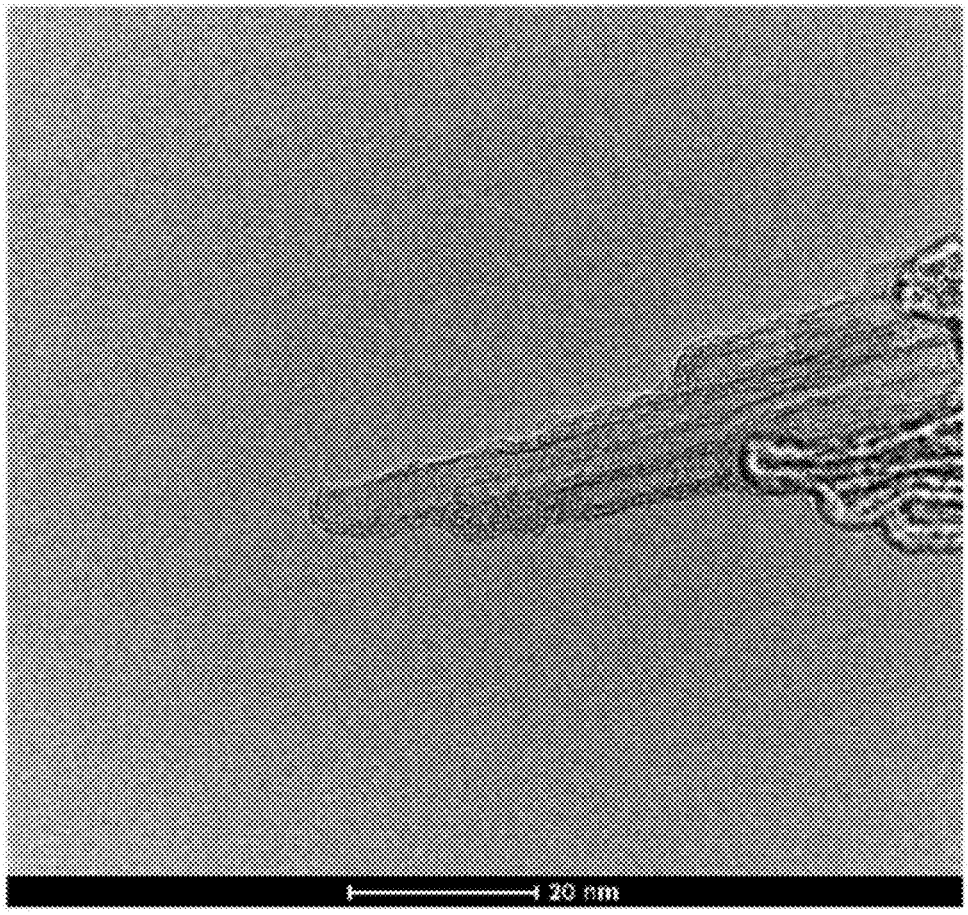
FIG. 7 shows a high-power TEM image of the taper-shaped tip of the broken carbon nanotube wire shown in FIG. 4.

If the scan power of the laser beam 14 is greater than about 10 watts and the scan speed of the laser beam 14 is smaller than about 200 millimeters per second, the predetermined position 124 of the carbon nanotube wire 12 receives more power. Thus, the carbon nanotube wire 12 is broken off rapidly such that the carbon nanotube wire 12 forms a prickly tip, as shown in FIG. 3, rather than the taper-shaped tip 122.

If the scan power of the laser beam 14 is in a range from about 1 watt to about 10 watts and a scan speed of the laser beam 14 is equal to or less than 200 millimeters per second, the carbon nanotube wire 12 is broken off such that the carbon nanotube wire 12 forms the taper-shaped tip 122.

In one embodiment, a method forming a number of tips for a number of carbon nanotube wires includes the steps of:

providing a number of carbon nanotube wires; and irradiating the carbon nanotube wires, along a predetermined path, by a laser beam until the carbon nanotube wires are broken off such that each of the carbon nanotube wires forms a taper-shaped tip.

In the step of irradiating the carbon nanotube wires, a scan power of the laser beam is in a range from about 1 watt to about 10 watts. A scan speed of the laser beam is equal to or less than 200 millimeters per second. More specifically, the carbon nanotube wires substantially extend along an axial direction and are substantially parallel to each other. The carbon nanotube wires are irradiated in turn by a facula of the laser beam along the predetermined path, such as a direction substantially perpendicular to the axial direction.

Figure 9:
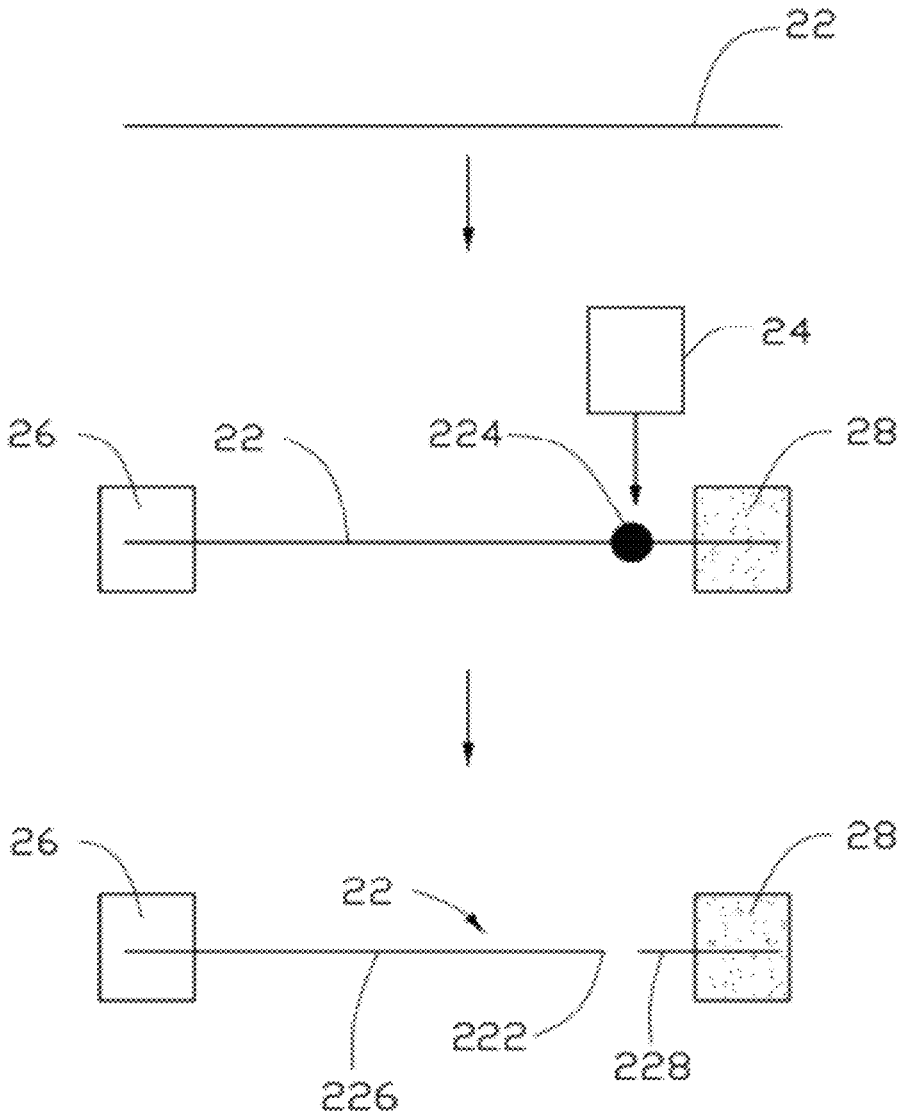
FIG. 9 is a schematic view of one embodiment of forming a field emission structure.

Referring to FIG. 9, one embodiment of a method of forming a field emission structure 20 includes the steps of:

S210, providing a carbon nanotube wire 22, a first electrode 26, and a second electrode 28;

S220, fixing the carbon nanotube wire 22 to the first electrode 26 and the second electrode 28; and S230, irradiating the carbon nanotube wire 22 by a laser beam 24 until the carbon nanotube wire 22 is broken off such that the carbon nanotube wire 22 forms a taper-shaped tip 222.

In the step 210, the carbon nanotube wire 22, which is similar to the carbon nanotube wire 12 as shown in FIG. 1, has two ends. The second electrode 28 is spaced from the first electrode 26. An interval between the first electrode 26 and the second electrode 28 is in a range from about 300 micrometers to about 500 micrometers. A material of the first electrode 26 and the second electrode 28 could be conductive thick liquid, copper, tungsten, gold, molybdenum, platinum, or any combination thereof.

In one embodiment, the first electrode 26 is a cathode, and the second electrode 28 is an anode. A fluorescent layer is disposed on a surface of the anode. The cathode and the anode are made of conductive thick liquid which includes powdered metal, powdered glass with a low fusion point, and binder. The powdered metal is powdered silver. The binder is terpineol or ethyl cellulose. A weight percentage of the powdered metal is in a range from about 50% to about 90%. A weight percentage of the powdered glass with a low fusion point is in a range from about 2% to about 10%. A weight percentage of the binder is in a range from about 10% to about 40%. The fluorescent layer is made by printing or plating fluorescent powder onto the surface of the anode. In one embodiment, a thickness of the fluorescent layer is in a range from about 5 micrometers to about 50 micrometers.

In the step 220, one end of the carbon nanotube wire 22 is fixed to the first electrode 26 using conductive adhesive. Simultaneously, another end of the carbon nanotube wire 22 is fixed to the second electrode 28 using conductive adhesive. Thus, the carbon nanotube wire 22 is electrically connected to the first electrode 26 and the second electrode 28.

In the step 230, the carbon nanotube wire 22 can be irradiated by the steps of:

S231, deposing the carbon nanotube wire 22 in a chamber with oxidizing gas; and S232, irradiating the carbon nanotube wire 22 at a predetermined position 224 by the laser beam 24 until the carbon nanotube wire 22 is broken off at the predetermined position 224 such that the carbon nanotube wire 22 forms an emitter 226 and a piece 228 of the carbon nanotube wire 22.

In the step S231, a volume percentage of the oxidizing gas in the chamber is greater than about 25%. The chamber can be filled with pure oxygen or air. In one embodiment, the chamber is filled with air.

In the step S232, the emitter 226 is fixed to the first electrode 26 and has a taper-shaped tip 222. Thus, the field emission structure 20 is formed. The predetermined position 224 is near the second electrode 28. A scan power of the laser beam 24 is in a range from about 1 watt to about 10 watts. A scan speed of the laser beam 24 is equal to or less than 200 millimeters per second. A cone angle of the taper-shaped tip 222 is in a range from about 10 degrees to about 17 degrees. Preferably, the cone angle of the taper-shaped tip 222 is in a range from about 12 degrees to about 15 degrees.

The scan power of the laser beam 24 is in a range from about 3.6 watts to about 6 watts. The scan speed of the laser beam 24 is in a range from about 5 millimeters per second to about 100 millimeters per second. Preferably, the scan speed of the laser beam 24 is in a range from about 5 millimeters per second to about 10 millimeters per second. The laser beam 24 can be a carbon dioxide laser, a semiconductor laser, an ultraviolet laser, or a YAG laser.

If the laser beam 24 is a YAG laser, relationships between the scan power and the scan speed of the laser beam 24 are shown in Table 1.

TABLE 1

| | Serial Number | | | | | | | | |
|---|---|---|---|---|---|---|---|---|---|
| | a | b | c | d | e | f | g | h | i |
| Scan Power (Watts) | 3.6 | 3.6 | 6 | 6 | 6 | 6 | 9.6 | 9.6 | 9.6 |
| Scan Speed (mm/second) | 5 | 10 | 5 | 10 | 50 | 100 | 5 | 10 | 50 |

Figure 10:
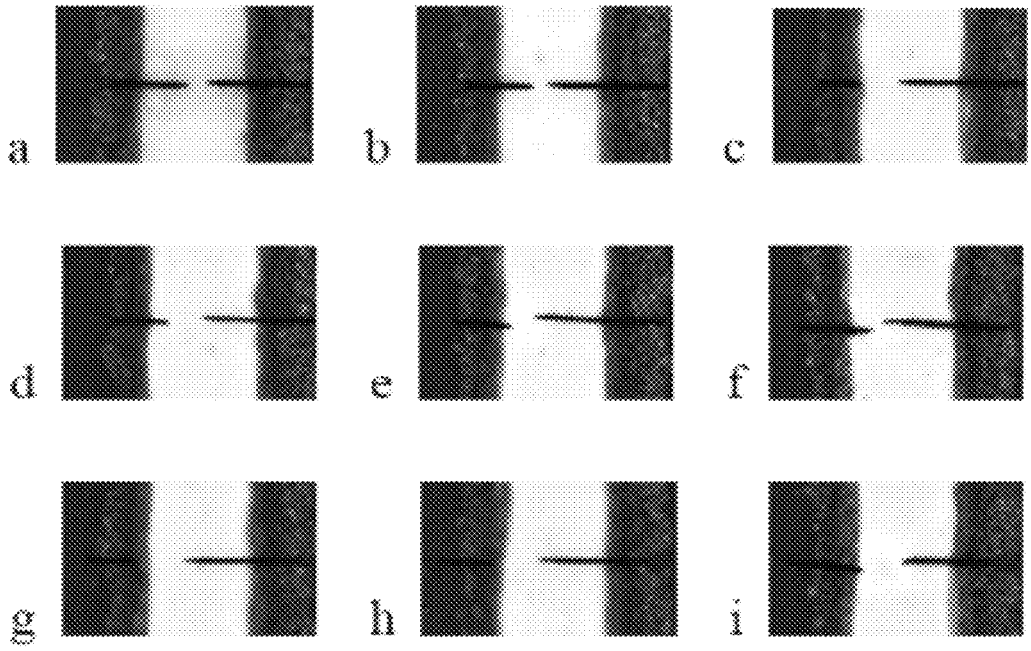
FIG. 10 is an image of embodiments of different field emission structures.

The field emission structures 20 of the emitter 226 formed by the laser beam 24 according to Table 1 are shown in FIG. 10.

After the carbon nanotube wire 22 is broken off at the predetermined position 224 by the laser beam 24, the emitter 226 and the piece 228 of the carbon nanotube wire 22 are formed. The emitter 226 electrically connected to the first electrode 26 has the taper-shaped tip 222. Simultaneously, the piece 228 of the carbon nanotube wire 22 electrically connected to the first electrode 26 has a taper-shaped tip 222. A field emission gap between the taper-shaped tips 222 of the emitter 226 and the piece 228 of the carbon nanotube wire 22 is equal to or less than 65 micrometers. Preferably, the field emission gap between the taper-shaped tips 222 of the emitter 226 and the piece 228 of the carbon nanotube wire 22 is in a range from about 15 micrometers to about 65 micrometers. More specifically, the piece 228 of the carbon nanotube wire 22 is a part of the second electrode 28. In one embodiment, the field emission gap is an interval between the taper-shaped tip 222 of the emitter 226 and the taper-shaped tip of the piece 228 of the carbon nanotube wire 22.

In one embodiment, a method of forming a number of field emission structures 20 includes:

providing a number of carbon nanotube wires 22, a number of first electrodes 26, and a number of second electrodes 28;

fixing the carbon nanotube wires 22 to the first electrodes 26 and the second electrodes 28, respectively; and irradiating the carbon nanotube wires 22, along a predetermined path, by a laser beam 24 until the carbon nanotube wires 22 are broken off such that each of the carbon nanotube wires 22 forms a taper-shaped tip 222.

In the step of irradiating the carbon nanotube wires 22, a scan power of the laser beam 24 is in a range from about 1 watt to about 10 watts. A scan speed of the laser beam 24 is equal to or less than 200 millimeters per second. More specifically, the carbon nanotube wires 22, the first electrodes 26, and the second electrodes 28 are arranged as an array. The carbon nanotube wires 22 are irradiated in turn by a facula of the laser beam 24 along the predetermined path to form a field emission structure array.

In one embodiment, 256 carbon nanotube wires 22, 256 first electrodes 26, and 256 second electrodes 28 are provided. One of the carbon nanotube wires 22, one of the first electrodes 26, and one of the second electrodes 28 form a field emission structure precursor. Thus, 256 field emission structure precursors are formed. More specifically, in each of the field emission structure precursors, the carbon nanotube wire 22 is fixed to the first electrode 26 and the second electrode 28. The field emission structure precursors can be arranged as a 16×16 array. Finally, the carbon nanotube wires 22 are irradiated along the predetermined path by the laser beam 24, until the carbon nanotube wires 22 are broken off such that the carbon nanotube wires 22 form 256 field emission structures 20 arranged as a 16×16 array.

Figure 11:
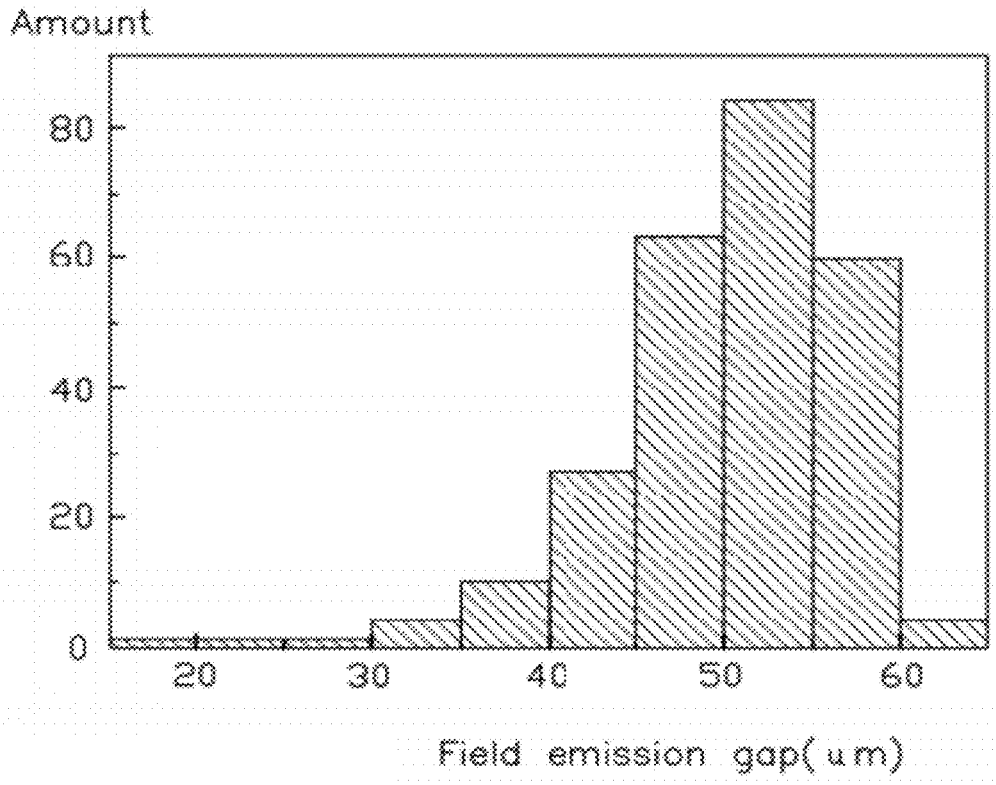
FIG. 11 is a bar chart of widths of emission gaps of 256 field emission structures.
Figure 12:
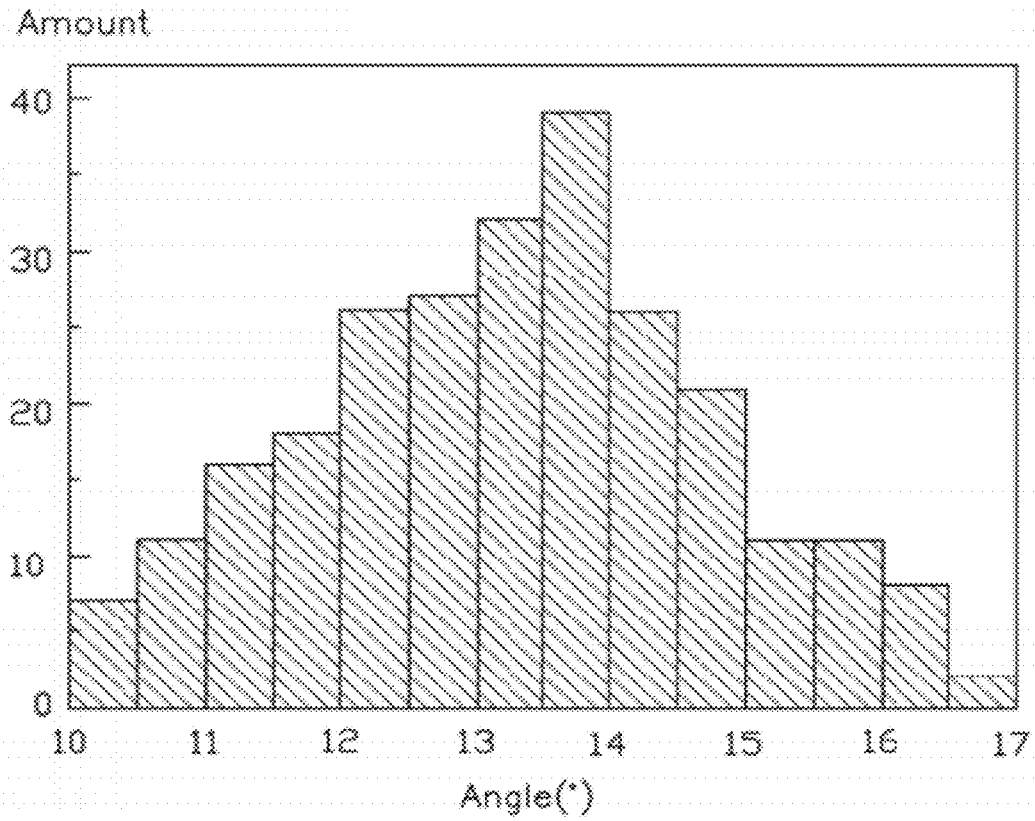
FIG. 12 is a bar chart of cone angles of taper-shaped tips of carbon nanotube wires of 256 field emission structures.

Referring to FIG. 11 and FIG. 12, most cone angles of the taper-shaped tips 222 of the emitters 226 of the 256 field emission structures 20 are distributed over a narrow area. Most field emission gaps between the taper-shaped tips 222 of the emitters 226 and the taper-shaped tips of the pieces 228 of the carbon nanotube wires 22 are also distributed over a narrow area. Thus, the taper-shaped tips 222 of the emitters 226 uniformly emit electrons. In addition, the taper-shaped tips 222 of the emitters 226 can emit electrons at a lower voltage because the field emission gap between the taper-shaped tip 222 of the emitter 226 and the taper-shaped tip of the piece 228 of the carbon nanotube wire 22 in each of the field emission structures 20 is smaller than about 65 micrometers.

Figure 13:
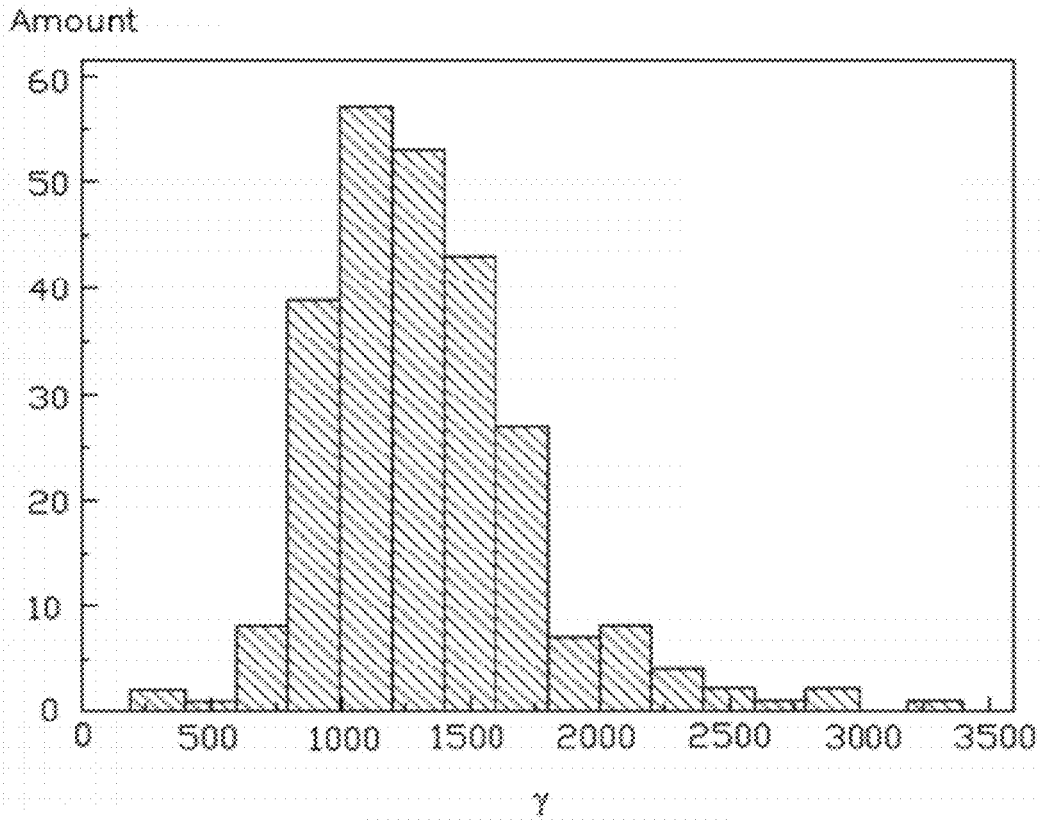
FIG. 13 is a bar chart of field enhancement factors of a 16×16 pixel unit composed of 256 field emission structures.
Figure 14:
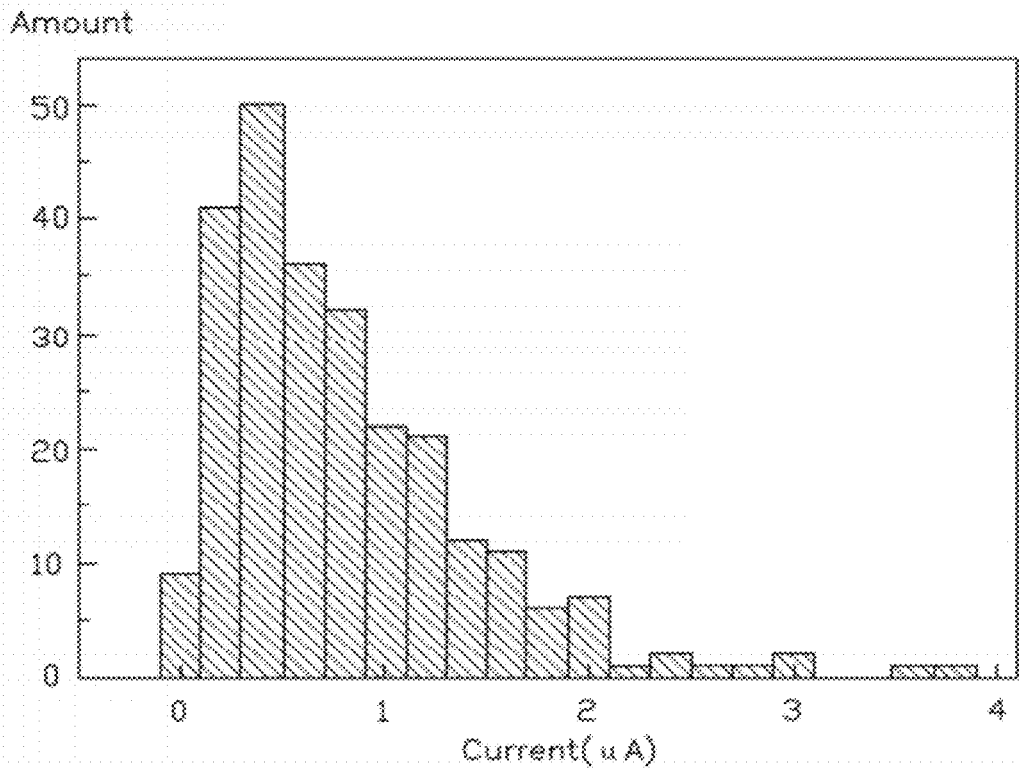
FIG. 14 is a bar chart of field emission currents of a 16×16 pixel unit composed of 256 field emission structures.
Figure 15:
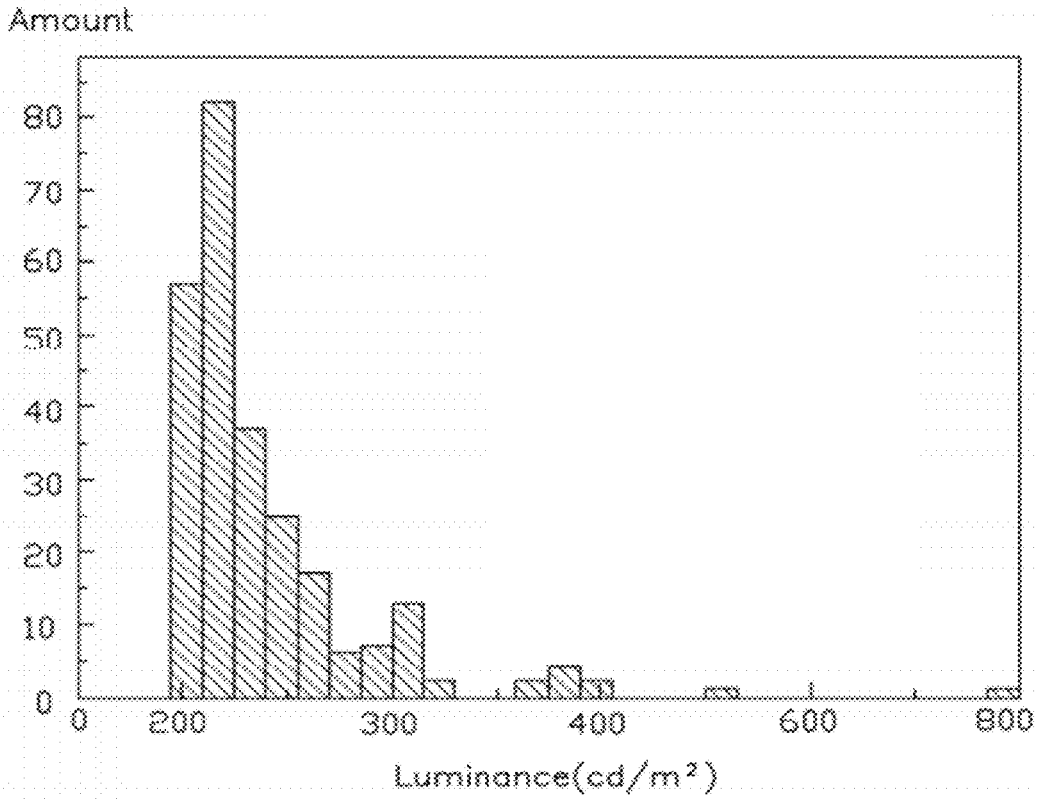
FIG. 15 is a bar chart of luminance of a 16×16 pixel unit composed of 256 field emission structures.

Referring to FIG. 13 to FIG. 15, when the 256 field emission structures 20 are applied as a 16×16 pixel unit in a display apparatus, the most field enhancement factors γ of the taper-shaped tips 222 of the emitters 226 of the 256 field emission structures 20 are distributed over a narrow area. Emission currents and luminance of the 256 field emission structures 20 are distributed as an exponential distribution.

Figure 16:
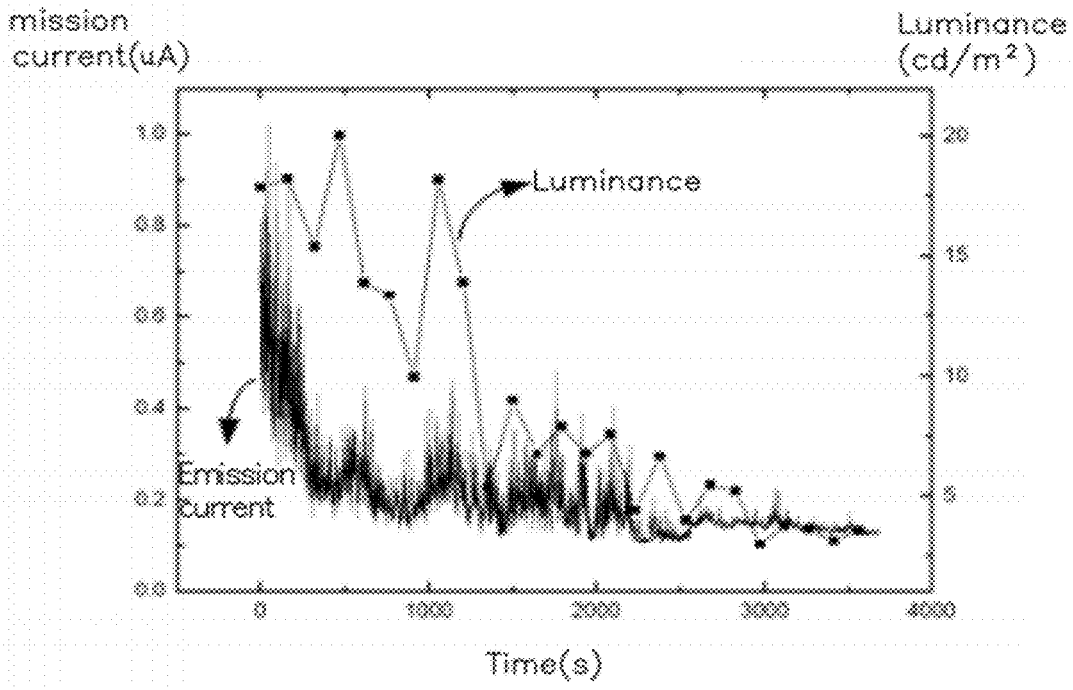
FIG. 16 is a waveform chart of a field emission current-time characteristic curve and a luminance-time of a field emission structure.

Referring to FIG. 16, the emission currents and luminance of the 256 field emission structures 20 are approximately stable even though the emission currents decay when it begins emitting electrons. In addition, referring to FIG. 17, the display apparatus having the field emission structures 20 can be normally operated.

Accordingly, the present disclosure is capable of providing a method forming a tip for a carbon nanotube wire, and a method for forming a field emission structure having the carbon nanotube wire. The carbon nanotube wire with the tip and the field emission structure having the carbon nanotube wire have the following benefits. First, the tip of the carbon nanotube wire is a taper-shaped tip such that the carbon nanotube wire has a bigger current density when applied. Second, a number of taper-shaped tips of the carbon nanotube wires uniformly emit electrons such that the field emission structures have stable field emission ability. Third, the tips of carbon nanotube wires are tapered such that the field enhancement factor of the field emission structure is improved, and thus the field emission characteristic of the field emission structure is improved.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

It is also to be understood that above description and the claims drawn to a method may include some indication in reference to certain steps. However, the indication used is only to be viewed for identification purposes and not as a suggestion as to an order for the steps.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A method for forming a tip for a carbon nanotube wire, the method comprising:

providing a carbon nanotube wire; and irradiating the carbon nanotube wire by a laser beam until the carbon nanotube wire is broken off such that the carbon nanotube wire forms a taper-shaped tip, wherein a scan power of the laser beam is in a range from about 1 watt to about 10 watts, and a scan speed of the laser beam is equal to or less than 200 millimeters per second.

2. The method as claimed in claim 1, wherein the carbon nanotube wire substantially extends along an axial direction, and the carbon nanotube wire is irradiated by the laser beam along a direction substantially perpendicular to the axial direction.

3. The method as claimed in claim 2, wherein the carbon nanotube wire comprises a plurality of carbon nanotubes substantially arranged along the axial direction of the carbon nanotube wire.

4. The method as claimed in claim 3, wherein the carbon nanotubes are substantially parallel to each other.

5. The method as claimed in claim 1, wherein the step of irradiating the carbon nanotube wire comprises:

deposing the carbon nanotube wire in a chamber with oxidizing gas; and irradiating the carbon nanotube wire at a predetermined position by the laser beam until the carbon nanotube wire is broken off at the predetermined position to form two separated carbon nanotube wires.

6. The method as claimed in claim 5, wherein each of the two separated carbon nanotube wires has the taper-shaped tip.

7. The method as claimed in claim 1, wherein a cone angle of the taper-shaped tip is in a range from about 10 degrees to about 17 degrees.

8. The method as claimed in claim 1, wherein the scan power of the laser beam is in a range from about 3.6 watts to about 6 watts.

9. The method as claimed in claim 8, wherein the scan speed of the laser beam is in a range from about 5 millimeters per second to about 100 millimeters per second.

10. The method as claimed in claim 1, wherein the taper-shaped tip comprises a plurality of carbon nanotubes each having closed ends.

11. A method for forming a plurality of tips for a plurality carbon nanotube wires, the method comprising:

providing a plurality of carbon nanotube wires; and irradiating the plurality of carbon nanotube wires along a predetermined path, by a laser beam until the plurality of carbon nanotube wires are broken off such that each of the carbon nanotube wires forms a taper-shaped tip, wherein a scan power of the laser beam is in a range from about 1 watt to about 10 watts, and a scan speed of the laser beam is equal to or less than 200 millimeters per second.

12. The method as claimed in claim 11, wherein the plurality of carbon nanotube wires substantially extend along an axial direction and are substantially parallel to each other, and the plurality of carbon nanotube wires are irradiated in turn by the laser beam along a direction substantially perpendicular to the axial direction.

13. A method for forming a field emission structure, comprising steps of:

providing a first electrode, and a second electrode spaced from the first electrode, and a carbon nanotube wire having two ends;

fixing the two ends of the carbon nanotube wire to the first electrode and the second electrode, respectively; and irradiating the carbon nanotube wire by a laser beam until the carbon nanotube wire is broken off such that the carbon nanotube wire forms a taper-shaped tip, wherein a scan power of the laser beam is in a range from about 1 watt to about 10 watts, and a scan speed of the laser beam is equal to or less than 200 millimeters per second.

14. The method as claimed in claim 13, wherein the step of respectively fixing the two ends of the carbon nanotube wire to the first electrode and the second electrode further comprises:

fixing one end of the carbon nanotube wire to the first electrode using conductive adhesive such that the carbon nanotube wire is electrically connected to the first electrode; and fixing another end of the carbon nanotube wire to the second electrode by conductive adhesive such that the carbon nanotube wire is electrically connected to the second electrode.

15. The method as claimed in claim 13, wherein the step of irradiating the carbon nanotube wire further comprises:

deposing the carbon nanotube wire in a chamber with oxidizing gas; and irradiating the carbon nanotube wire at a predetermined position by the laser beam until the carbon nanotube wire is broken off at the predetermined position to form two separated carbon nanotube wires.

16. The method as claimed in claim 15, wherein each of the two separated carbon nanotube wires has the taper-shaped tip.

17. The method as claimed in claim 16, wherein the two separated carbon nanotube wires are respectively fixed to the first electrode and the second electrode.

18. The method as claimed in claim 13, wherein the scan power of the laser beam is in a range from about 3.6 watts to about 6 watts.

19. The method as claimed in claim 18, wherein the scan speed of the laser beam is in a range from about 5 millimeters per second to about 100 millimeters per second.

20. The method as claimed in claim 13, wherein a diameter of the carbon nanotube wire is in a range from about 0.5 nanometers to about 100 micros.

* * * * *